US006924599B2

(12) United States Patent
Döll et al.

(10) Patent No.: US 6,924,599 B2
(45) Date of Patent: Aug. 2, 2005

(54) DIELECTRIC BARRIER DISCHARGE LAMP WITH STARTING AID

(75) Inventors: Gerhard Döll, Ulm (DE); Wolfgang Kumpf, Herbrechtingen (DE); Joseph-A. Olsen, Gloucester, MA (US)

(73) Assignee: Patent-Treuhaud-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/307,306

(22) Filed: Dec. 2, 2002

(65) Prior Publication Data

US 2003/0111960 A1 Jun. 19, 2003

(30) Foreign Application Priority Data

Dec. 14, 2001 (EP) ..... 01129856

(51) Int. Cl.[7] ..... H01J 17/16

(52) U.S. Cl. ..... 313/634; 315/56; 315/330; 313/637

(58) Field of Search ..... 315/246, 248, 315/100–109, 56–65, 326, 124, 203, 204, 330, 335; 313/564, 490, 566, 552, 619, 620, 631, 642, 33, 54, 113, 623, 640, 641, 635–638, 489

(56) References Cited

U.S. PATENT DOCUMENTS 4,329,621 A * 5/1982 Barakitis et al. ..... 315/106
4,701,667 A 10/1987 Cinalli
4,777,399 A * 10/1988 Miyazaki et al. ..... 313/54
4,891,551 A * 1/1990 Will et al. ..... 313/492
4,996,606 A * 2/1991 Kawai et al. ..... 315/248
5,117,160 A * 5/1992 Konda et al. ..... 315/326
5,146,135 A * 9/1992 Lagushenko ..... 313/619
5,432,398 A 7/1995 Kogelschatz ..... 313/25
5,668,440 A * 9/1997 Inukai et al. ..... 313/635
5,907,216 A * 5/1999 Ligthart et al. ..... 313/564
6,097,155 A 8/2000 Vollkommer et al. ..... 315/58
6,297,599 B1 10/2001 Dirscherl et al. ..... 315/246
6,781,315 B2 * 8/2004 Nishio et al. ..... 315/56

FOREIGN PATENT DOCUMENTS

| | | |
|---|---|---|
| EP | 0 671 758 | 9/1995 |
| EP | 1 067 582 | 1/2001 |
| WO | WO 98/40900 | 9/1998 |

OTHER PUBLICATIONS

Coaton, Lamps and Lighting, 1997, John Wiley & Sons, Inc. p. 107.*

* cited by examiner

*Primary Examiner*—Wilson Lee
(74) *Attorney, Agent, or Firm*—William E. Meyer

(57) ABSTRACT

In order to improve the starting of a dielectric barrier discharge lamp it is proposed to provide elements for igniting an auxiliary discharge inside the exhaust tube (5) of the lamp.

16 Claims, 7 Drawing Sheets

DIELECTRIC BARRIER DISCHARGE LAMP WITH STARTING AID

TECHNICAL FIELD

The invention relates to dielectric barrier discharge lamps.

Starting of dielectric barrier discharge lamps (also known as dielectrically impeded or silent discharge lamps) is more difficult than starting of conventional discharge lamps such as low pressure fluorescent lamps. This is because no metallic electrodes reach into the discharge space which could be used to emit initial electrons by thermal or field emission. In dielectric barrier discharge lamps a metallic electrode is covered by a dielectric barrier which prevents electrons from the electrodes to reach the discharge space.

In case of so-called internal electrodes—the electrodes are for example provided on the inner surface of the discharge vessel—a dielectric layer covers the electrodes of distinguished polarity (unilaterally dielectrically impeded discharge) or all electrodes, i.e. of both polarities (bilaterally dielectrically impeded discharge). In case of so-called external electrodes the walls of the discharge vessel act as the dielectric barrier. For more details see U.S. Pat. No. 6,097,155.

In any case, in order to start the lamp, initial charges which are within the discharge volume have to be multiplied by an electrical field in a very effective way in order to achieve an electrical breakdown (ignition) of the gas. In this regard the initial ignition of dielectric barrier discharge lamps or ignition after relatively long pauses or ignition in dark places are even more critical.

BACKGROUND ART

U.S. Pat. No. 5,432,398 discloses a dielectric barrier discharge lamp with improved ignition by providing means for local field distortion in the discharge space. The means is for example a disturbing body made of aluminium oxide or tantalum oxide.

DISCLOSURE OF THE INVENTION

It is an object of the invention to provide another means for improving the starting of a dielectric barrier discharge lamp.

The object is achieved by a dielectric barrier discharge lamp comprising a discharge vessel having at least one tipped-off exhaust tube, the discharge vessel being filled with a filling gas, main electrodes and at least one means for igniting an auxiliary discharge inside said exhaust tube.

The auxiliary discharge facilitates the ignition of the main discharge within the interior of the discharge vessel. The main discharge is generated between the main electrodes.

The means for igniting is for instance a coil wound around the exhaust tube or at least one auxiliary electrode provided along the exhaust tube.

The purpose of the coil or the at least one auxiliary electrode is to facilitate an auxiliary discharge originating within the interior of the exhaust tube.

The means for igniting is preferably in electrical contact with a main electrode. That way, a separate power supply for the means for igniting the auxiliary discharge is not necessary.

The coil or the at least one auxiliary electrode is preferably mounted on the exhaust tube in proximity to the discharge vessel, i.e. away from the tipped-off portion of the exhaust tube.

In case of a single auxiliary electrode the (dielectrically impeded) auxiliary discharge is generated between the auxiliary electrode and the main electrode of opposite polarity. In case of a pair of auxiliary electrode the (dielectrically impeded) auxiliary discharge is generated between both auxiliary electrodes. The latter is assumed to be the preferred variant, because of the higher electrical field strength due to the shorter distance between both auxiliary electrodes compared to the longer distance between an auxiliary electrode and a main electrode.

In a preferred embodiment the auxiliary electrode is belt-shaped and coaxially aligned with the exhaust tube.

In order to further enhance the ignition of the discharge the inner surface of the exhaust tube can be covered with a material having a high secondary electron emission coefficient, e.g. MgO or $Al_2O_3$ or a mixture thereof.

Furthermore, the ignition of the dielectric barrier discharge lamp can be improved by providing a metallic structure inside the exhaust tube. The metallic structure enhances the strength of the electrical field inside the exhaust tube (metallic field enhancer). In addition, metallic components in the exhaust tube increase the probability for field emission of electrons due to their low work function in comparison to glass or other non conductive oxides. The metallic structure is for example U-, ring- or coil-shaped. In any case, in order to prevent the metallic structure from shielding the electrical field, the metallic structure preferably covers only a partial zone between the auxiliary electrodes. Even a patch-shaped metallic layer covering only a part of the inner wall of the exhaust tube between the auxiliary electrodes proved to be effective. Furthermore, metals with low work function are preferred for the metallic structure. As an alternative the metallic structure can be covered with a material lowering the work function.

In order to prevent surface creeping discharges the auxiliary electrodes are preferably covered at least in part by an insulating material, e.g. silicon or silicon gel.

BEST MODE FOR CARRYING OUT THE INVENTION

Figure 1A:
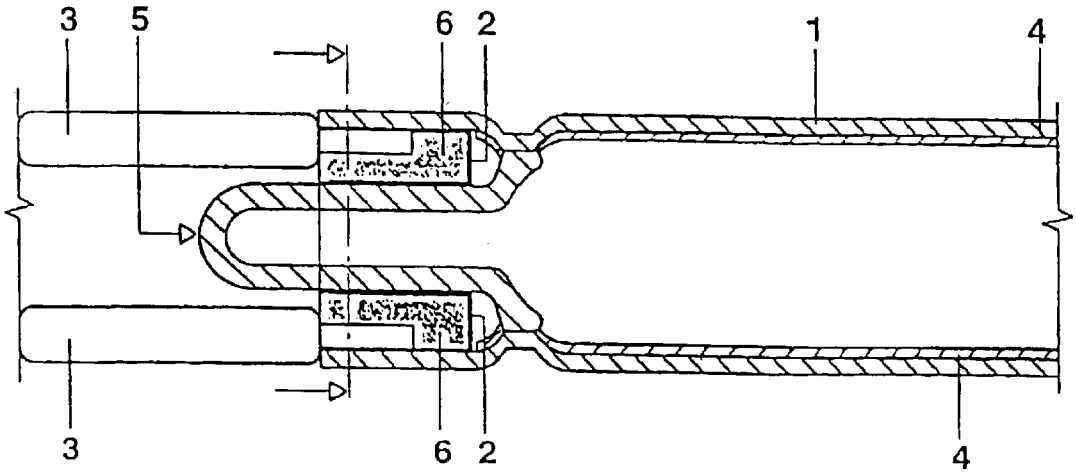
FIG. 1*a* shows a longitudinal section of a dielectric barrier discharge lamp with auxiliary electrodes for improved ignition according to the invention.
Figure 1B:
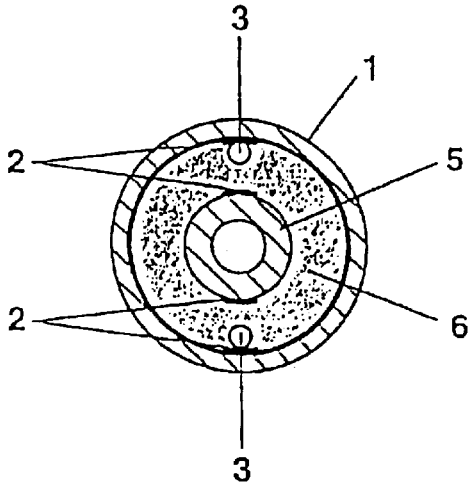
FIG. 1*b* shows a cross section of the dielectric barrier discharge lamp shown in FIG. 1*a,*

FIGS. 1*a* and 1*b* show a longitudinal section and a cross-section, respectively, of a first embodiment of a dielectric barrier discharge lamp according to the invention for OA (=Office Automation) applications. The dielectric barrier discharge lamp essentially comprises a tubular discharge vessel 1, two strip-shaped internal (main) electrodes (not shown), two strip-shaped auxiliary electrodes 2 and two supply leads 3. The main electrodes are in electrical contact with the supply leads (not shown). Dielectric barrier 4 covering each electrode is shown in FIG. 1*a*. The general concept of this kind of dielectric barrier discharge lamp with internal (main) electrodes is described in detail in U.S. Pat. No. 6,097,155, particularly in the description of FIGS. 1*a*, 1*b* and 2 therein. The discharge vessel 1 is sealed in a gas-tight fashion at its first end by means of a flare mount with a tipped-off exhaust tube 5 and at its second end by a dome (not shown) formed from the vessel. The discharge vessel 1 is filled with Xenon at a filling pressure of 15 kPa. Each auxiliary electrode 2 is U-shaped. A first shank of each U-shaped auxiliary electrode 2 is in electrical contact with one supply lead 3. The second shank of each U-shaped auxiliary electrode 2 is in contact with the outer surface of the exhaust tube 5. Each auxiliary electrode 2 is coaxial aligned with the exhaust tube 5 (see FIG. 1*b*). During the ignition phase a high voltage is applied to the supply leads 3. The strength of the electrical field generated by the auxiliary electrodes 2 within the exhaust tube 5 is higher than within the discharge vessel, because the of the smaller inner diameter of the exhaust tube 5 in comparison to the inner diameter of the discharge vessel 1. Therefore, ignition of an auxiliary dielectric barrier discharge between the auxiliary electrodes 2 and within the interior of the exhaust tube 5 is facilitated. Eventually, the auxiliary discharge initiates the ignition of the main discharge. In order to prevent surface discharge along the outer surface of the exhaust tube 5 the space between the auxiliary electrodes 2 is insulated with silicon 6. In addition arcing can be avoided by applying a silicon gel along the glass surface between the electrodes (not shown). Both auxiliary electrodes 2, the silicon 6, and the high voltage supply leads 3 are integrated to a single structure which is placed onto the lamp and soldered to the main electrodes of the lamp.

In order to further enhance starting of the discharge the inner surface of the flare can also be coated with materials with high secondary electron emission capability such as $Al_2O_3$ or MgO.

Figure 2A:
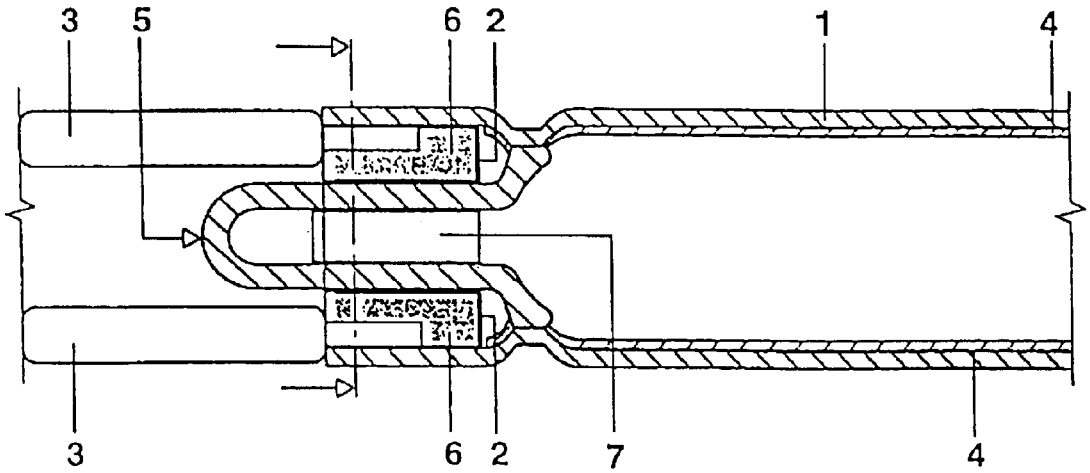
FIG. 2*a* shows a longitudinal section of a first variation of the dielectric barrier discharge lamp shown in FIG. 1*a* additionally having a layer of high secondary electron emission capability.
Figure 2B:
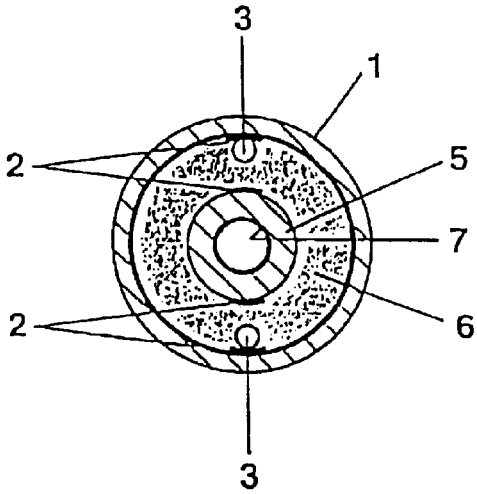
FIG. 2*b* shows a cross section of the dielectric barrier discharge lamp shown in FIG. 2*a,*

FIGS. 2*a* and 2*b* show a variation of the above lamp with a coating 7 made of MgO on the inner surface of the exhaust tube 5. Since MgO is a good secondary electron emitter, the coating 7 enhances the electron density.

Figure 3A:
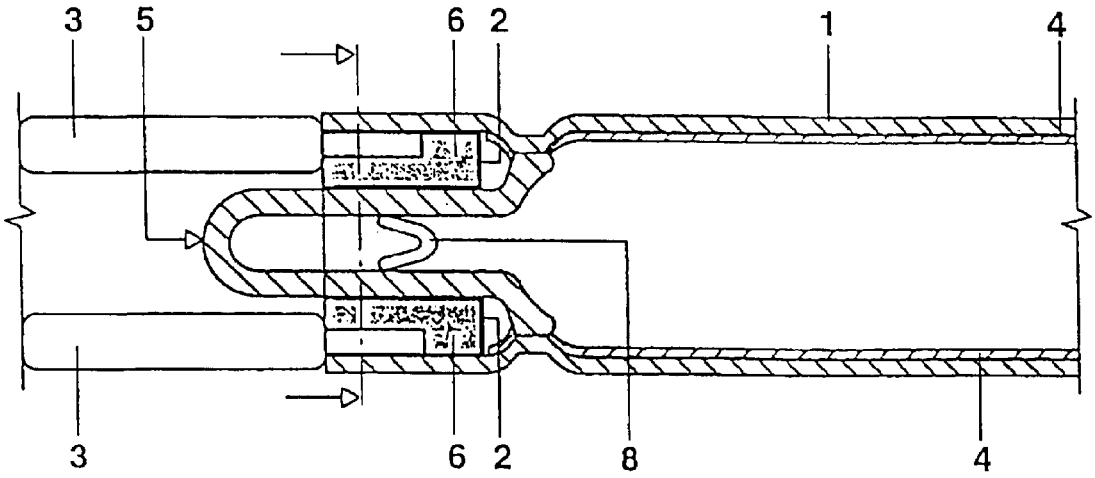
FIG. 3*a* shows a longitudinal section of a second variation of the dielectric barrier discharge lamp shown in FIG. 1*a* additionally having a U-shaped field enhancer.
Figure 3B:
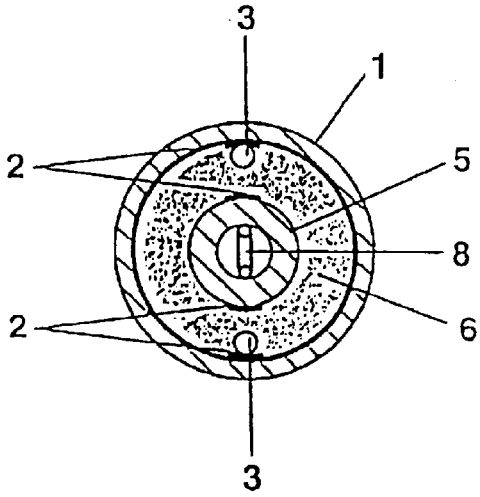
FIG. 3*b* shows a cross section of the dielectric barrier discharge lamp shown in FIG. 3*a,*
Figure 4A:
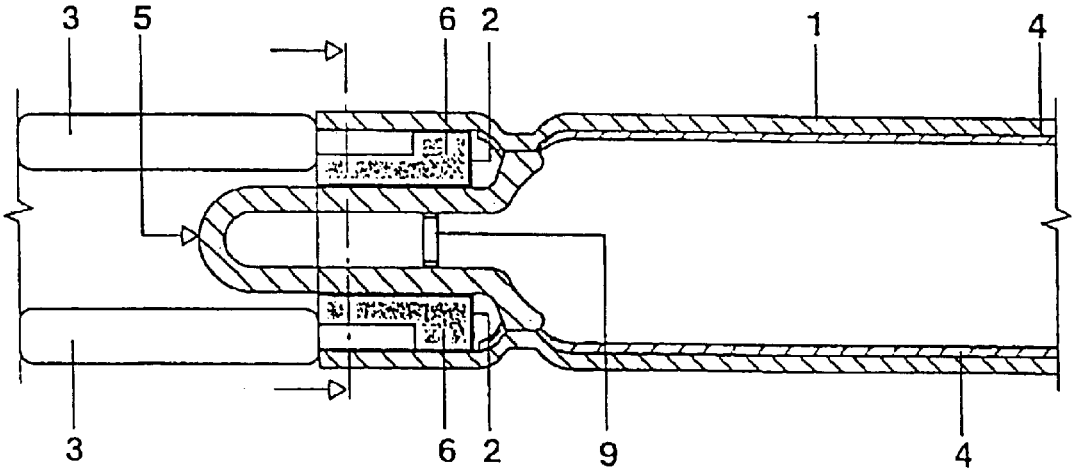
FIG. 4*a* shows a longitudinal section of a third variation of the dielectric barrier discharge lamp shown in FIG. 1*a* additionally having a ring-shaped field enhancer.
Figure 4B:
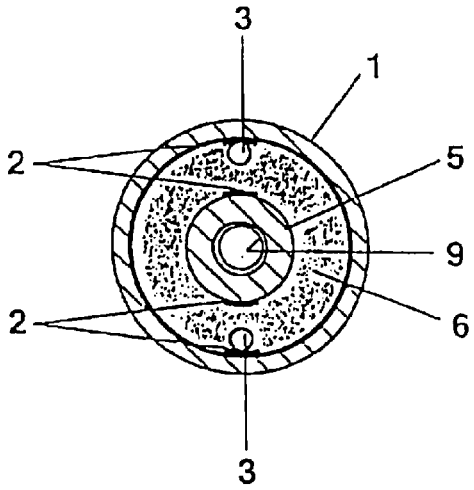
FIG. 4*b* shows a cross section of the dielectric barrier discharge lamp shown in FIG. 4*a,*
Figure 5A:
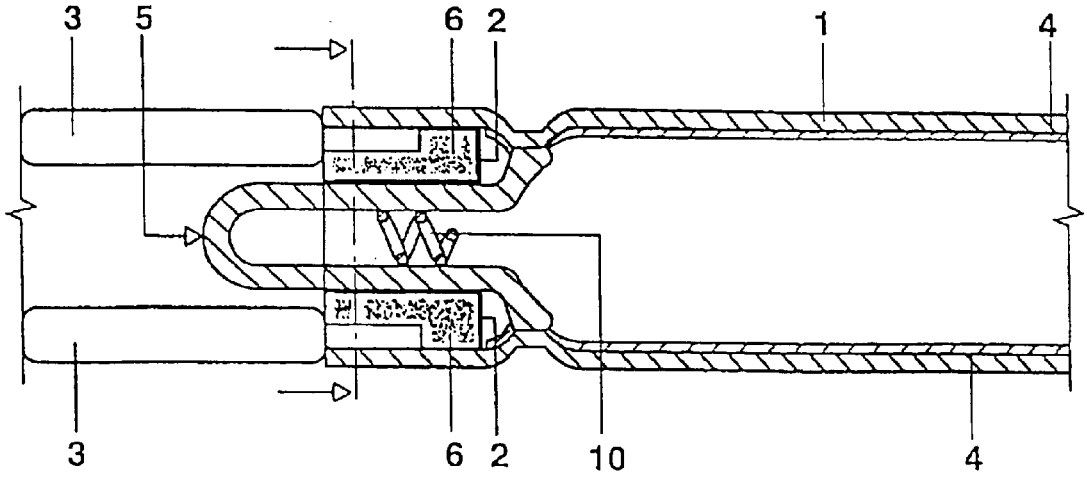
FIG. 5*a* shows a longitudinal section of a fourth variation of the dielectric barrier discharge lamp shown in FIG. 1*a* additionally having a coil-shaped field enhancer.
Figure 5B:
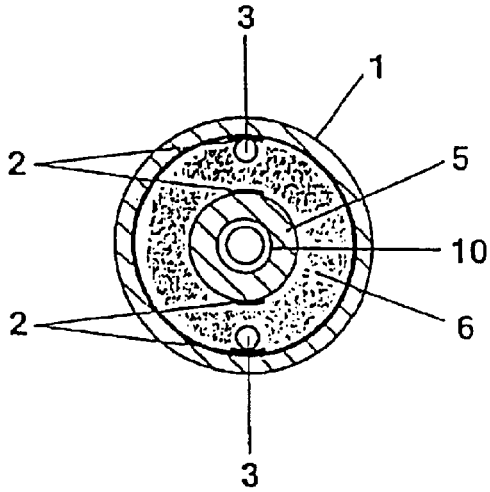
FIG. 5*b* shows a cross section of the dielectric barrier discharge lamp shown in FIG. 5*a,*
Figure 6A:
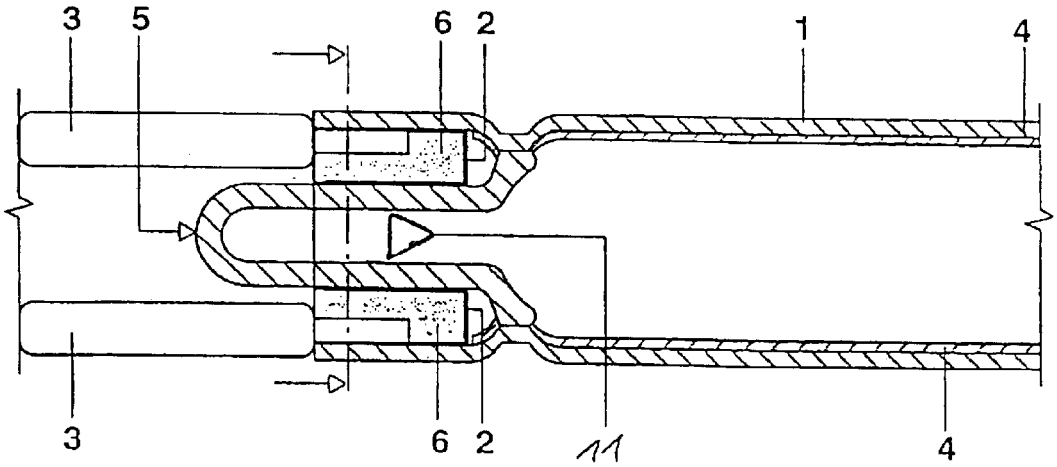
FIG. 6*a* shows a longitudinal section of a fifth variation of the dielectric barrier discharge lamp shown in FIG. 1*a* additionally having a patch-shaped field enhancer.
Figure 6B:
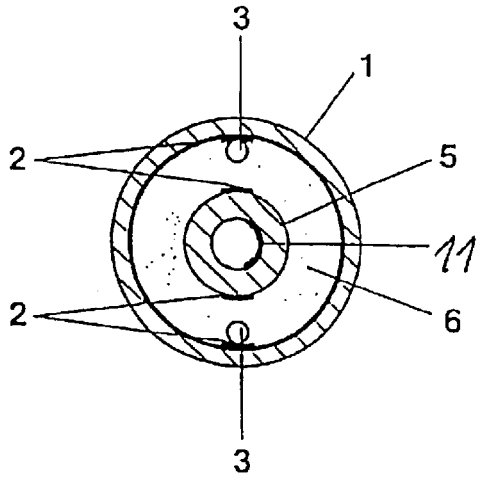
FIG. 6*b* shows a cross section of the dielectric barrier discharge lamp shown in FIG. 6*a*.

FIGS. 3*a*, 3*b*, 4*a*, 4*b*, 5*a*, 5*b* and 6*a*, 6*b* show further variations of the dielectric barrier discharge lamp as shown in FIGS. 1*a*, 1*b*. Further enhancement of starting is achieved by placing metal structures in the interior of the exhaust tube 5, which enhance the strength of the electrical field inside the exhaust tube 5 (metallic field enhancer). In addition, metallic components in the exhaust tube 5 increase the probability for field emission of electrons due to their low work function in comparison to glass or other non conductive oxides. FIGS. 3*a*, 3*b* show a dielectric barrier discharge lamp with a U-shaped field enhancer 8. FIGS. 4*a*, 4*b* show a dielectric barrier discharge lamp with a ring-shaped field enhancer 9. FIGS. 5*a*, 5*b* show a dielectric barrier discharge lamp with a coil-shaped field enhancer 10. In a further variation, schematically shown in FIGS. 6*a*, 6*b*, the metallic field enhancer consists of a metallic layer covering a part of the cylindrical inner wall of the exhaust tube between the auxiliary electrodes. The layer is applied as a patch 11 of silver paste which is also used for printing the electrodes. The silver patch 11 is formed in a triangular shape on the cylindrical inner wall of the exhaust tube 5 with two of its three corners facing the two auxiliary electrodes 2 and the third corner facing towards the interior of the discharge vessel 1. The length of the patch 11 in the longitudinal direction of the exhaust tube 5 is about 2 mm. In the direction of the circumference of the cross section of the exhaust tube the patch 11 extends approximately from one auxiliary electrode to the other, therefore covering an angle of approximately 180°.

Figure 7:
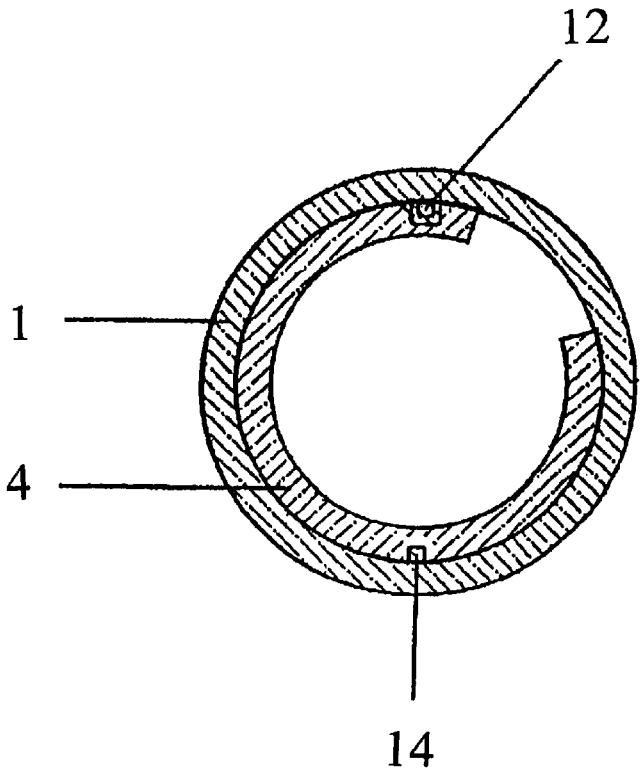
FIG. 7 shows a cross section of a dielectric barrier discharge lamp with two inner wall main electrodes.

FIG. 7 shows a cross section of a dielectric barrier discharge lamp with two inner wall electrodes. FIG. 7 shows first and second inner wall main electrodes 12, 14. Since both electrodes are located inside the discharge vessel 1, the first main electrode 12, and second main electrode 14 are covered by a dielectric layer 4.

Even though the invention has been explained in detail with reference to dielectric barrier discharge lamps with internal electrodes the invention is not restricted to this kind of dielectric barrier discharge lamp. Rather, the benefits of the invention can also be achieved by applying the invention to lamps with external main electrodes.

What is claimed is:

1. A dielectric barrier discharge lamp comprising: a discharge vessel having at least one tipped-off exhaust tube, the vessel defining a main cavity in open connection with a minor cavity defined by the exhaust tube, the discharge vessel being filled with a filling gas, main electrodes positioned on the vessel and adjacent to the main cavity but separated by a dielectric barrier from the main cavity, and at least one auxiliary electrode positioned on the exhaust tube and adjacent to the minor cavity but separated by a dielectric barrier from the minor cavity for igniting a discharge inside said exhaust tube.

2. The dielectric barrier discharge lamp according to claim 1, wherein the at least one auxiliary electrode is coaxial with the exhaust tube.

3. The dielectric barrier discharge lamp according to claim 1, wherein the auxiliary electrode is in electrical contact with a main electrode.

4. The dielectric barrier discharge lamp according to claim 1, wherein at least a part of the inner surface of the exhaust tube is covered with a material having a high secondary electron emission coefficient.

5. The dielectric barrier discharge lamp according to claim 4, wherein the material with high electron emission coefficient includes MgO.

6. The dielectric barrier discharge lamp according to claim 1, which also includes a metallic structure arranged inside the exhaust tube.

7. The dielectric barrier discharge lamp according to claim 6, wherein the metallic structure is U-shaped.

8. The dielectric barrier discharge lamp according to claim 6, wherein the metallic structure is ring-shaped.

9. The dielectric barrier discharge lamp according to claim 6, wherein the metallic structure is coil-shaped.

10. The dielectric barrier discharge lamp according to claim 6, wherein the metallic structure is a metallic layer formed on the exhaust tube.

11. The dielectric barrier discharge lamp according claim 6, wherein the work function of the metallic structure is lower than glass.

12. The dielectric barrier discharge lamp according claim 6, wherein the metallic structure is covered with a material having a lower work function than that of the metallic structure.

13. The dielectric barrier discharge lamp according to claim 1, wherein the at least one auxiliary electrode is covered at least in part by an insulating material.

14. The dielectric barrier discharge lamp according to claim 13, wherein the insulating material is silicone.

15. The dielectric barrier discharge lamp according to claim 13, wherein the insulating material is a gel.

16. The dielectric barrier discharge lamp according to claim 4, wherein the material with high electron emission coefficient includes $Al_2O_3$.

* * * * *